United States Patent [19]

Kramer

[11] 3,992,895

[45] Nov. 23, 1976

[54] DEFROST CONTROLS FOR REFRIGERATION SYSTEMS

[76] Inventor: Daniel E. Kramer, 2009 Woodland Drive, Yardley, Pa. 19067

[22] Filed: July 7, 1975

[21] Appl. No.: 593,841

[52] U.S. Cl. ..... 62/155; 62/80

[51] Int. Cl.[2] ..... F25D 21/02

[58] Field of Search ..... 62/155, 80, 234, 180

[56] References Cited

UNITED STATES PATENTS 3,894,404 7/1975 Stanton ..... 62/155

*Primary Examiner*—William E. Wayner

*Attorney, Agent, or Firm*—Daniel E. Kramer

[57] ABSTRACT

A defrost control system for the defrosting evaporators of a refrigeration system which utilizes a first timer which runs continuously and attempts to initiate evaporator defrost at predetermined times and a second timer which accumulates compressor operating time and prevents defrost initiation by the first timer at those preselected times until a predetermined period of operation of the refrigerating system has occurred.

7 Claims, 6 Drawing Figures

DEFROST CONTROLS FOR REFRIGERATION SYSTEMS

FIELD OF THE INVENTION

The storage and processing of commercial quantities of food requires large amounts of mechanical refrigeration which is frequently supplied by multiples of relatively small refrigeration systems, each of which is connected to one or more refrigeration blowers or evaporators. These evaporators characteristically collect frost on their heat transfer surfaces and are therefore equipped with means for warming the evaporator surfaces to thaw the frost, causing it to melt and flow through a drain to waste. This invention relates to the timing of the initiation for the defrost of these refrigeration blowers or evaporators.

DISCUSSION OF THE PRIOR ART

Cooling coils designed for the refrigeration of rooms whose temperature is intended to be 40° F or below almost invariably collect frost on their refrigerating surfaces. If this frost is allowed to collect, unimpeded, without periodically being removed, the thickness of frost which accumulates impedes the flow of air across the refrigerating surfaces and reduces the efficiency of the refrigerating evaporator or blower to the extent that increased refrigeration system operating time is required at the expense of increased power consumption and operating costs and reduced refrigerating capacity. Reduced capacity caused by excess frost accumulation on the refrigerating surfaces can also result in the temperature of the refrigerated space increasing intolerably. To cope with this frosting situation, refrigerating engineers have developed means for supplying heat to these frost accumulating surfaces of the evaporator for the purpose of raising these surfaces above the melting point of the accumulated frost, causing this frost to turn to water and, in liquid form, to drain away to waste, leaving the refrigerated surfaces free of frost and able, on resumption of the refrigeration cycle, to perform their refrigerating function unimpeded. Usual means for applying heat to the frosted surfaces may be by way of electric resistance heaters inserted in or strapped to the frosting surfaces, or hot fluid circulated through tubes attached to or traversing the frosting surfaces. The hot fluid may be oil or brine circulated in tubes within the frosting assembly separate from those tubed used for refrigeration or hot refrigerant vapor, such as that discharged by the compressor, circulated in the same tubes in the frosting assembly which are used for creating the refrigerating effect which originally led to the frosted condition.

Known techniques for initiating the defrost depending either on clock time, which causes each defrost to occur at predetermined times, (cyclic system) or on schemes, which cause defrosts to occur randomly on the happening of some event or the change in some characteristic or condition related to frost buildup on the frosting coil (permissive or demand system).

For example:

1. The utilization of a continuously operating time clock preset to regularly initiate defrost at predetermined times. (cyclic)

2. Accumulating the compressor operating time since the last defrost by a time clock electrically connected to run only when the refrigeration compressor is operating and which initiates defrost. (permissive)

3. Monitoring the resistance to air flow generated by the fans on the refrigerating element and initiating defrost when sufficient frost has accumulated to block the air passages to the point where the resistance to air flow has increased to a preset limit of the measured parameter or condition such as air velocity of air pressure drop (permissive).

Both cyclic and demand defrost control systems are commercially satisfactory where only one refrigerating system refrigerates an enclosure. However, where a multiplicity of refrigerating systems refrigerates a single enclosure, the use of demand defrost controls for each system has been found to produce at least two problems:

a. Unsatisfactory defrosting of the frosted element caused by movement of cold box air into the defrosting evaporator, displacing the warmed air produced by the defrost mechanism, and b. The corrolary effect, circulation of warmed humid air from the defrosting element into the freezer, causing fog and deposition of snow on the walls and stored frozen product.

These two problems arise because the demand defrost control by its nature does not require all evaporators to defrost at the same time but permits some to defrost while others are still refrigerating or have their fans operating. This fan operation induces air motion through the coils of the defrosting evaporators precipitating the harmful effects.

It has occurs found that the most reliable and trouble-free evaporator defrosting occuts where all of the evaporators in a given cooler or freezer defrost simultaneously. (Subsequently, the term freezer will be used to denote either a cooler or a freezer.) When all systems defrost simultaneously, the fans which circulate air over the refrigerating and frosting elements are simultaneously turned off. As a result, forced air motion in the freezer stops. Consequently, the action of the defrost heaters at each element is unimpeded by the forced or induced flow of cold room air over the thawing, frosted element. Since the room air may be 0°, −10° or even colder, it is apparent that forced movement of this below-freezing air into contact with the thawing element will cause the thawed moisture to refreeze, generating the nucleus of an uncontrollable icing condition. Since the prior art had available only these two types of defrost controls, at this time the industry has standardized on simultaneous defrost whenever multiple systems refrigerate one box. It has been found that the process of defrosting an evaporator located in a freezer requires a certain amount of heat to be delivered to the evaporator for the purpose of warming it and thawing the frost collected on it. The power to supply the heat is either delivered by the compressor, if the system for defrosting is of the hot gas type, or is delivered by resistance heaters in contact with the frosting evaporator. These heaters consume about the same power that the compressor consumes. In addition, it has been found that the heat delivered to the freezer or cooler by the defrosting process constitutes an appreciable heat load in the cooler or freezer and that consequently the refrigeration compression must run for an appreciable period of time to pump out the heat delivered into the box by the defrost process. Refrigerating engineers have determined that for each minute of defrost time, approximately one minute of compressor operating time is required. For maximum efficiency, a system which is refrigerating most of the time, should defrost six times a day. The defrost periods frequently require 20 minutes for the defrost and another 20 minutes of compressor operation to withdraw from the box the heat delivered to it by the defrosting operation. Therefore, an equivalent compressor operating time equal to six defrosts per day × (20 minutes per defrost + 20 minutes compressor operation required by the defrost) = 240 minutes equivalent compressor operating time, or four hours per day. Good engineering design or selection of refrigeration systems provides for sufficient capacity to withdraw in 18–20 hours of operation all the heat which will leak into the refrigerator from thermal conductivity of the walls, floors and ceiling, from air leakage into the box and from heat brought in in warm product, which heat must be removed. The remaining 4–6 hours can be, and, in fact, are, devoted to the defrosting process and the removal of the heat load imposed by the defrosting process. This four hours of required operation is a necessary burden which is imposed on all defrosting systems.

If, for any reason, a refrigerating system should operate fewer than 18 hours, for instance, only 9 hours, then, ideally, it would accumulate only half as much frost and require only half as many defrosts, reducing from 4 hours to 2 hours the equivalent compressor operating time required for defrost and the removal of the associated heat input.

Where there are two or more systems which refrigerate one box, it is expected, and good engineering design provides for, essentially all of the systems to run under summer conditions when the heat load on the box is high. Then the ratio of the defrost burden of 4 hours to the total compressor operating time of 22 hours (18 + 4) is 18%. As the weather becomes cooler and the load on the box decreases, however, some of the machines refrigerating the box will continue to operate, but the remainder of the machines will shut off under temperature control and not operate, there being no need for their refrigerating capacity under the reduced load conditions. However, with the traditional defrost timing system, all of these systems will initiate defrost once every 4 hours even though the system on which defrost is initiated has not performed any effective refrigeration since the termination of the last defrost and therefore has no frost on its frosting element. In other words, it does not need a defrost. Therefore, with the traditional defrost controls it is apparent that where there are two or more refrigerating systems on one box the minimum operating time of every system is four hours per day, even though there is no need for refrigeration at all. As pointed out before, the application of a demand or "permissive" system of defrost control would eliminate the extra energy consumption but would increase the likelihood that those evaporators which require defrost would fail to defrost completely because of the excessive air motion within the freezer, caused by the fans of the non-defrosting evaporators.

SUMMARY OF THE INVENTION

This invention is an improved defrost control for refrigeration systems which are designed to be used in multiples within large freezers and achieves the objective of providing for simultaneous defrost of all evaporators which require defrost and simultaneously provides for turning off the fan on those evaporators which do not require defrost without imposing a defrost on those frost-free evaporators at all.

The invention achieves its desirable effect by combining the permissive or demand defrost control with the traditional clock-type or cyclic control, which initiates defrost at pre-determined intervals. Throughout the remainder of this specification I will refer to this traditional timer, which initiates defrost at pre-determined intervals, as the cyclic control, in order to differentiate it from other controls which may be employed for the permissive function.

The permissive control may be of any type of which the following are examples:

1. Air pressure differential type. This type employs a sensor to the air pressure differential type. This type employs a sensor to the air pressure differential across the frosting coil and actuates a switch to initiate defrost when enough frost has accumulated to increase the static resistance to air movement across the coil to a preset value.

2. Air velocity type. Accumulated frost on the coil reduces the air velocity through it by partly or fully blocking the air flow passages. An air velocity sensor initiates defrost when the air velocity falls below a preset value.

3. Temperature difference between the air entering and the air leaving the coil. This temperature difference increases as the air quantity across the coil is reduced by the interfering effect of the accumulated frost. Defrost is initiated when the difference increases to a preset value.

4. Temperature difference between the evaporating refrigerant in the frosting element and the air temperature traversing the coil. This temperature difference increases as the capacity of the element is reduced through the reduction in air quantity caused by the accumulation of frost on the refrigerating element. Defrost is initiated when the temperature difference increases to a preset value.

5. Compressor operating time. Here a timer is connected to run only when the compressor is running. This timer accumulates or integrates the compressor operating time until a pre-determined total compressor operating time has occurred, at which time it allows defrost to initiate.

If the permissive control has not reached a condition where, had it been the sole control, it would have initiated a defrost, the cyclic timer at pre-determined times will only stop the evaporator fans and the compressor, ensuring non-interference with evaporators actually defrosting. If the permissive control has reached that condition at which it would have allowed defrost to occur had it been the sole control, the cyclic timer will at its appointed times still stop the evaporator fans, but the permissive control will now allow heat to be applied to the evaporator to thaw the frost accumulated on it. In this way, the needless substantial extra power consumption generated by four hours per day of operation of every refrigeration compressor is reduced in accord with the actual periods of compressor operation.

The application of the improved defrost control system of this invention will provide substantial power saving resulting in improved overall operating efficiency and power economy for any group of systems required to refrigerate one box where periodic defrosting is required.

DETAILED DESCRIPION OF THE DRAWINGS

Figure 1:
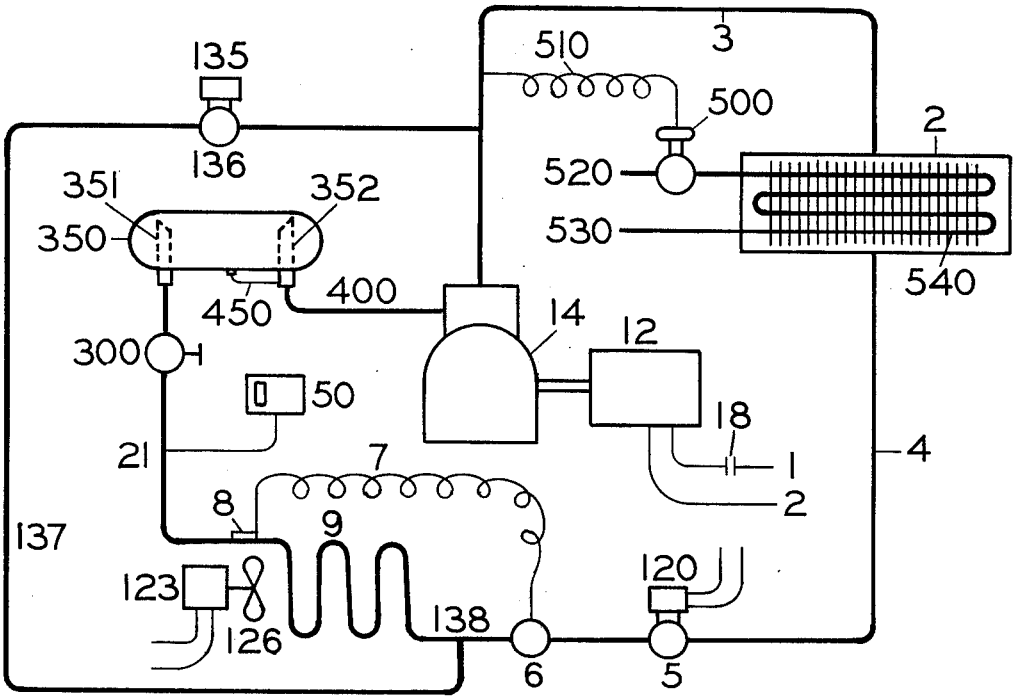
FIG. 1 is a schematic piping diagram of a mechanical refrigeration system employing a motor-driven compressor and utilizing an air cooling frosting evaporator together with hot gas defrosting means to which the defrosting control of this invention could be applied.

FIG. 1 is a schematic piping diagram of a mechanical refrigeration system employing hot gas defrost of the evaporator with which a defrost control system, employing the principle of this invention, can be employed. Compressor 14 compresses gaseous refrigerant received by it through its suction line and discharges the refrigerant at higher pressure through discharge line 3 to condenser 2. The compressor 14 is driven by a motor 12. In condenser 2 the hot vapor refrigerant is condensed to a liquid by cooling coils 540, utilizing water entering through pipe 520 and leaving through pipe 530. The water flow is controlled by water regulator 500 under control of the pressure sensing tube 510, which opens the valve to allow more water to flow when the pressure is higher and less water to flow when the pressure drops below a preset value. The condensed refrigerant, now a liquid, leaves the condenser 2 by way of liquid line 4, traverses on/off control valve 5 and enters the thermal expansion valve 6, which is under the control of temperature sensing bulb 8, strapped to the suction outlet of evaporator 9. This bulb communicates the temperature of the suction outlet to the expansion valve 6 by way of capillary tube 7.

The combination of the control valve 5 and its controlling solenoid coil 120 is called a liquid solenoid valve. For simplicity in subsequent discussion of the drawings, where magnetic coils control operative valve or switch elements, reference to energization or deenergization of the magnetic coil will imply corresponding action of the controlled element.

The liquid refrigerant is reduced in pressure and temperature by its controlled flow through thermal expansion valve 6 and it enters the evaporator 9 by way of inlet conduit 138. In the evaporator, heat is imparted to the liquid refrigerant by way of fan 126, driven by fan motor 123, which drives the air to be cooled over the tubes and fins of the evaporator. Within the evaporator, the liquid refrigerant is evaporated to dryness and the resulting head-laden refrigerant vapor travels to the compressor by way of suction line 21, outlet pressure regulator, hereafter called holdback valve 300, suction accumulator 350, which includes inlet tube 351, outlet 352 and oil and refrigerant metering tube 450 and enters the compressor by way of its suction connection 400 for recompression and recycling as heretofor described.

A defrost control, described later, acting to begin defrost, shuts off evaporator fan 123, closes liquid solenoid 120 and opens hot gas solenoid 135, which allows hot vapor discharged by compressor 14 to flow through solenoid valve 135, hot gas line 137 and evaporator inlet 138, into evaporator 9, where it gives up its heat, condenses to a liquid in part and warms the evaporator sufficiently to thaw the frost which previously had deposited on its fins. A high pressure mixture of liquid and gas is drawn back to the compressor by way of suction line 21. Its high pressure is reduced by holdback valve 300 to a level tolerable by the low temperature compressor. Liquid refrigerant, resulting from the defrost, is separated out in suction accumulator 350 and the remaining vapor is delivered to the compressor suction for recompression and recirculation back to the defrosting evaporator for the continuation of the defrosting cycle until such time as the defrost is terminated by closing hot gas solenoid 135, opening liquid solenoid 120/5 and resuming operation of the evaporator fan 126 by reenergizing its driving motor 123. Note that the compressor, which is under the primary control of its low pressure switch 50, will run during defrost even if the liquid solenoid was closed and the compressor was off at the time defrost initiated. This is because the opening of the hot gas solenoid 135/136 by the defrost control acts to raise the pressure in the low side to the cut-in of the low pressure switch by delivering gas to it. The low pressure switch thereupon starts the compressor and keeps it running for the duration of the defrost. If the thermostat was closed just before defrost started, the heat delivered to the freezer by the defrosting evaporator 9 will cause thermostat 110 (FIGS. 3, 4, 5, 6) to open liquid solenoid 120/5 until the heat added to the freezer by the defrost has been removed by the cooling action of the system.

Figure 2:
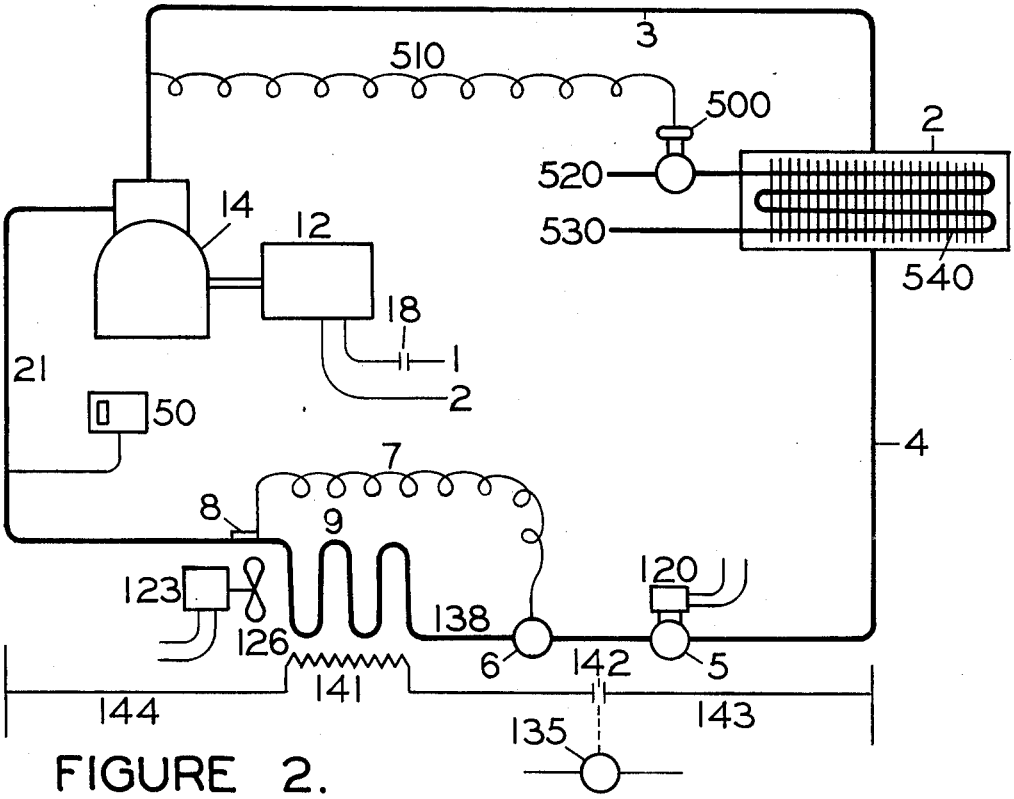
FIG. 2 is a schematic piping diagram of a mechanical refrigeration system including a motor-driven compressor and an air cooling frosting evaporator including means for defrosting the evaporator through the use of an electrical resistance heater to which the defrosting control of this invention could be applied.

FIG. 2 has a refrigeration portion which is identical in operation and employs the same components as the refrigeration system of FIG. 1. It lacks, however, hot gas defrosting means comprising hot gas line 137, hot gas solenoid valve 135/136, holdback valve 300 and suction accumulator 350. In its stead, FIG. 2 shows a defrost resistance heater 141 in heat transfer relationship with evaporator 9 and so arranged that its heat is communicated to and warms the evaporator 9 for the purpose of thawing the frost previously deposited on it during periods of operation of the refrigeration compressor.

The defrost operation employs the following sequence. The defrost control (1) deenergizes solenoid 120, (2) closes solenoid valve 120/5, (3) deenergizes evaporator fan motor 123, stopping the operation of the evaporator fan 126, and (4) energizes magnetic contactor coil 135, causing switch 142 to close. This switch allows electricity to flow through the defrost heater 141 which delivers its heat to evaporator 9. This raises its temperature to the melting point of the frost, causing the frost to thaw and drop off the evaporator to a drain pan and to waste. When the defrost control terminates defrost, it deenergizes coil 135, causing contacts 142 to open, whereupon electric heater 141, deprived of its source of electricity, stops heating. Power is re-applied to fan motor 123, which resumes driving fan 126, reestablishing the flow of air to be cooled over evaporator 9 and solenoid coil 120 is reenergized, allowing solenoid valve 120/5 to open, again delivering liquid refrigerant to expansion valve 6 and to evaporator 9. The compressor 14 in this system stops during the course of the defrost, since the closing of solenoid valve 120/5 during the defrost cycle deprives the compressor 14 of its source of refrigerant vapor and its continued operation after the closing of solenoid valve 120/5 causes the pressure on the low side to drop to a predetermined setting of a low pressure switch which opens the control circuit to the electric motor 12 causing it to stop. When defrost is concluded, the reopening of liquid solenoid 120/5 allows the pressure in the low side 21 to rise, allowing the pressure switch to close the circuit to compressor motor 12, causing the motor to start and the compressor, in turn, to resume refrigeration.

Figure 3:
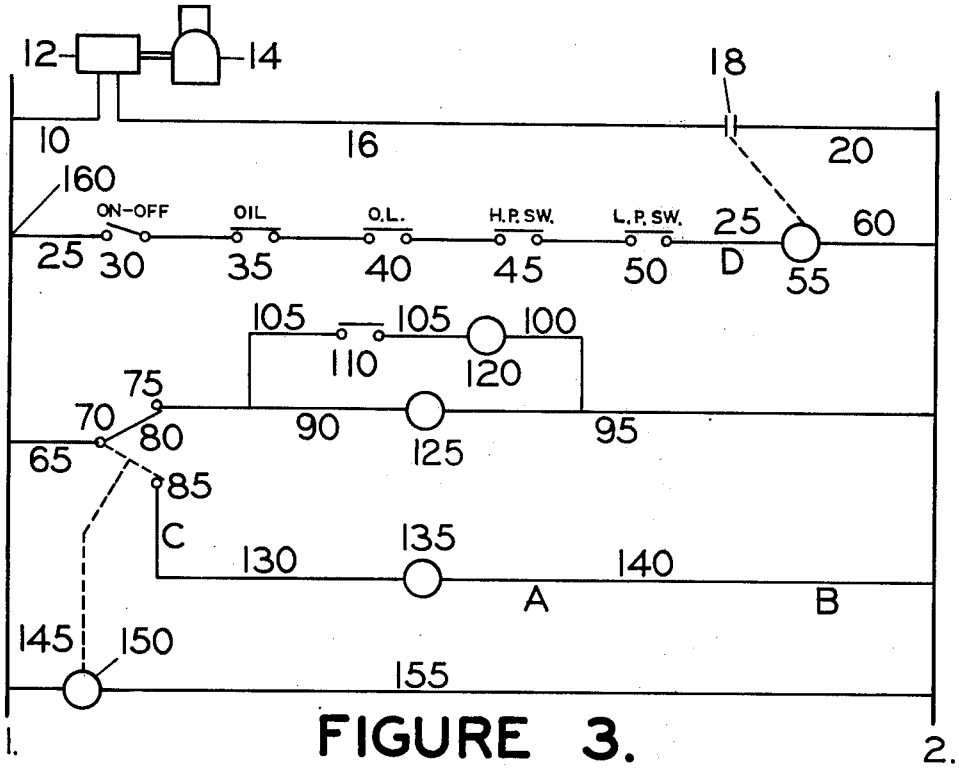
FIGURE 3. PRIOR ART
FIG. 3 is a schematic wiring diagram for refrigeration and defrost control representing typical practice of the prior art using well-known principles which could be used in systems of FIG. 1 or FIG. 2.

FIG. 3 is a schematic wiring diagram utilizing well-known principles and not utilizing the principle of this invention. This diagram includes the compressor operating control circuit and the defrost control circuit for the refrigeration system and the defrost system in both FIGS. 1 and 2. Compressor motor 12 is supplied with power through its lead 10 connected directly to circuit 1 and lead 16 connected to circuit 2 through switch 20. Switch 18 is of the magnetic type and is closed when coil 55 is energized through its leads 25 and 60. Lead 60 is directly connected to power source 2; lead 25 is connected to power source 1 through a series of control and safety switches; an on/off switch 30, compressor overload switch 35, oil safety switch 40, high pressure cutout 45, and low pressure switch 50. Other switches may be used for other purposes and some of these switches may be omitted where not essential. Normally, the on/off switch 30, the overload 35, the oil safety switch 40 and the high pressure switch 40 are closed. Low pressure switch 50 constitutes the operating control for the compressor motor. It has two settings - the higher pressure at which its contacts close, the cut-in setting; and the lower pressure at which its contacts open, the cut-out setting. When pressure in the low side has been reduced to the cut-out setting by the action of compressor 14, the low pressure switch opens and stops the flow of electricity to magnetic coil 55. This causes contact 18 to open and interrupt the power supply to compressor motor 12, causing it to stop. When the pressure in the low side rises to the cut-in setting of low pressure switch 50, its contacts close, establishing power to the magnetic coil 55, causing compressor contacts 18 to close and start the operation of compressor motor 12. The rise of the pressure in the low side to the cut-in is a result of the opening of liquid solenoid 120 or, in FIG. 1, of the opening of the hot gas solenoid 135/136.

The defrost control primarily is actuated by time clock employing a motor 150 and a switch, having moving contact 80, which contacts stationary contacts 75 and 85 in turn. When the moving contact 80 establishes continuity with stationary contact 75 under the control of the timer motor, the system is on the refrigeration cycle. Power is supplied to evaporator fan motor 125, causing its fan 126 to operate to blow air over the evaporator coil 9. Power is also supplied to liquid solenoid coil 120, through thermostat 110, causing the valve to be open or closed, depending on the condition of thermostat switch 110. The thermostat switch 110 has an element (not shown) which senses the temperature of the cooled space and causes the switch to be closed when the temperature of the space is above the pre-set temperature and to be open when the action of the compressor has lowered the temperature of the cooled space to the pre-set temperature. The starting and stopping of the compressor in accord with the opening and closing of the solenoid valve 120/5 has been described above. When the timer reaches the time pre-set for the beginning of the defrost cycle, it moves movable contact 80 from its refrigerating position on stationary contact 75, to its defrost position on stationary contact 85. This has the following effects: (1) it removes power from the evaporator fan, causing them to stop, and (2) simultaneously, regardless of the condition of thermostat contact 110, removes power also from solenoid coil 120, causing its valve 5 to close; (3) it supplies electricity to coil 135. If the system is of hot gas defrost type like the system of FIG. 1, 135 is the coil of a hot gas solenoid valve 136, which now opens. Gas flows to the low side, raising the temperature to the cut-in of low pressure switch 50, causing the compressor to run (or continue running) and defrosting the evaporator. When the time for defrost has expired, the timer restores movable contact 80 to refrigerating position, on stationary contact 75, again causing the evaporator fans 125 to run, allowing thermostat contact 110 to control the operation of the liquid solenoid, at the same time discontinuing the application of power to coil 135, which causes the solenoid valve 136 to close, discontinuing the defrost action.

If the system is of the electric defrost type, like the system of FIG. 2, steps 1 and 2 are the same as with the hot gas system described above. The remaining steps in the defrost process are as follows: (3) moving timer contact 80 supplies power to the stationary contact 85, causing coil 135 to become energized.

Coil 135 causes contact 142 (FIG. 2) to close, supplying heat to heater 141 to defrost coil 9. Since the liquid solenoid closes when defrost starts and there is no hot gas solenoid to deliver gas to the evaporator to maintain low side pressure above the cut-out setting of pressure switch 50; when defrost starts, the action of the compressor immediately lowers the pressure to the low side to the cut-out setting of low pressure switch 50 and the compressor stops.

Figure 4:
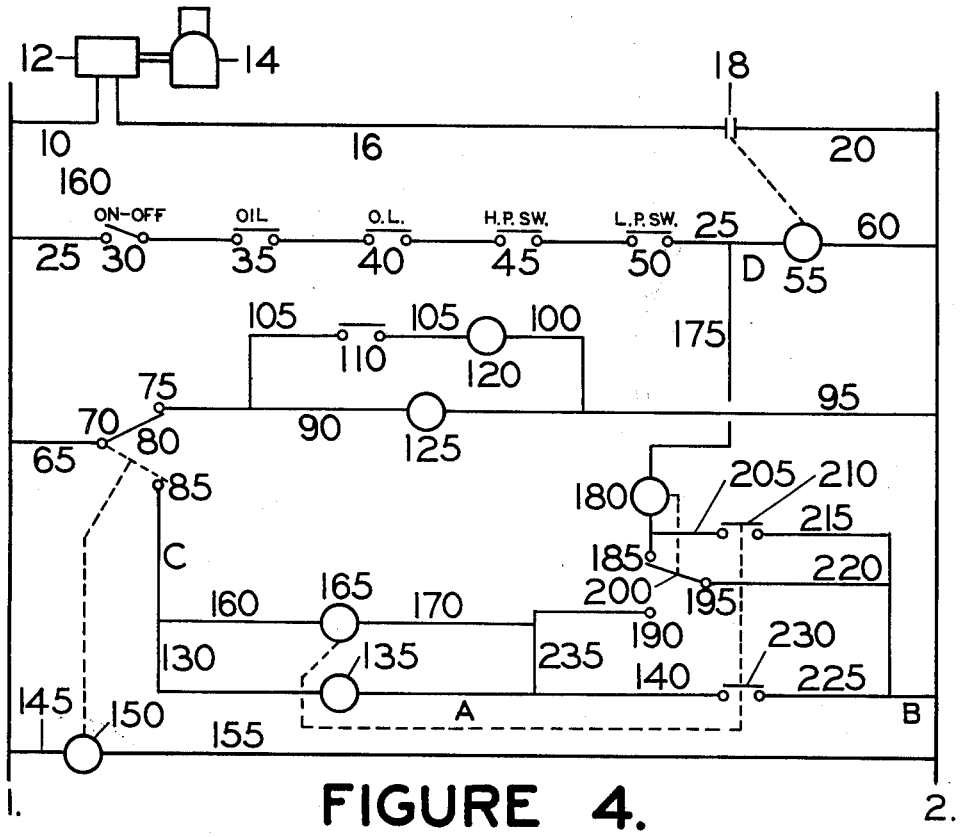
FIG. 4 is a schematic control wiring diagram for a refrigeration system utilizing hot gas defrost which demonstrates the practice of this invention through the use of a continuously running cyclic timer and a permissive timer which runs only when the compressor runs.

FIG. 4 exhibits the principle of the invention. It uses the same basic control system for both compressor control and defrost as FIG. 3 with added components. FIG. 4 is adapted only for use with the refrigeration system similar to FIG. 1 which utilizes hot gas defrost or any other defrost scheme which requires the compressor to operate throughout the defrost period. To apply the principles of the invention to the diagram of FIG. 3 this diagram 4 adds the following two components:

1. Relay having coil 165 actuating simultaneously two normally open switches 210 and 230; and
2. A permissive timer, having a motor 180 and a single pole double throw switch, having a moving contact 200 and two stationary contacts 190 and 185.

The timer may be of fixed setting or adjustable though the one or preference is adjustable and has a cycle time of one hour during which the movable element is maintained on stationary contact 190 for five minutes or less. Timer motor 180 has one lead connected at Position D on lead 25 of magnetic contactor coil 55 between the low pressure switch 50 and the magnetic coil 55. The other lead of timer motor 180 is connected to stationary contact 185 of its own switch and to one contact of relay switch 210. The other contact of relay switch 210 is connected by its lead 215 to point A on wire 225. The moving contact 200 of the timer switch is also connected by its terminal 195 and wire 220 to Point A on wire 225. Wire 225 is connected at one end to main power supply 2 and at its other end to one contact of relay switch 230. The other contact of relay switch 230 is connected via wire 140 to magnetic coil 135. The stationary contact 190 of the timer switch is connected by lead 235 to Position A on wire 140. Relay coil 165 is connected by its lead 160 to Position C on wire 130 and by its lead 170 to a point in wire 235.

The operation of FIG. 4 is as follows:

Assume that moving contact 200 is on stationary contact 185 and it has just moved there following a brief 5-minute period on contact 190. Timer 180 will have to run 55 minutes before moving contact 200 will again move back to contact 190 from its present position on contact 185. Whenever magnetic coil 55 is energized, which results in closing contact 18 and causing the compressor to run, power is also supplied to timer motor 180 through its lead 175 and through closed contact 185–195 wire 220 and 225 back to power supply 2.

This series of connections in essence puts timer 180 in parallel with magnetic contactor coil 55 so that whenever the magnetic contactor coil 55 is energized, timer motor 180 operates. Naturally, whenever the compressor is off because magnetic coil 55 is not energized, then timer motor 180 does not operate. If the use requirement of the refrigeration system is low, many hours may elapse without any operation of the system at all. During this period, cycle timer 150 may cause its moving element 80 to move from the operating contact 75 to the defrost contact 85. However, with the permissive timer switches positioned as described, the circuit to hot gas solenoid coil 135 will not be complete because contact 190 of the timer switch is open and contact 230 of the relay is open. So, timer 150 will traverse the entire defrost cycle having performed only the operation of removing power from the evaporator fan or fans 125 and removing power from the liquid solenoid 120, causing the machine to stop and the evaporator fans to turn off but without causing any defrost to occur and without thereby adding any heat to the freezer or refrigerator. Naturally, the defrost need not have occurred since the duration of compressor operating time was not nearly sufficient to accumulate a significant amount of frost on its refrigerating surfaces. If, after a period of time, operating conditions of the refrigerator or freezer change, increasing the heat load and demanding operation of the refrigeration system, timer 180 would operate and accumulate the number of minutes operating time that the compressor ran up to the point that permissive timer's moving element 200 was transferred by the timer from contact 185 to contact 190. At that time, even though the compressor's contactor 55 continued to be energized timer motor 180 would stop. This is because though its lead 175 was energized, the other lead of timer motor 180 is connected to two open switches, 210 and 185. Therefore, permissive timer 180 would remain with its moving contact in connection with its contact 190 regardless of whether compressor contactor 55 was energized or not. With permissive timer moving contact 200 on its stationary contact 190, the system is now in a permissive condition for defrost to occur on the next regular defrost cycle generated by timer motor 150 when its moving contact 80 moves from contact 75 to defrost position on contact 85. Then both the hot gas solenoid coil 135 and relay coil 165 would be energized because the power supply line 2 would communicate with both these coils by way of wire 225, wire 220, moving contact 200, stationary contact 190 and wire 235. At that moment that cyclic timer 80 moves to stationary contact 85, and hot gas solenoid 135 is energized, beginning the defrost, relay coil 165 also is energized. This causes both its normally open switches 210 and 230 to close. When switch 210 closes, it causes permissive timer motor 180 to be energized because the compressor runs during hot gas defrost. Five minutes after the beginning of the defrost, the permissive timer causes its moving contact 200 to move from stationary contact 190 (5 minute duration) to its stationary contact 185. This action does not cause the defrost to terminate by deenergizing coil 138 because closed relay switch 230 bridges the now-open permissive timer switch 190–195 and keeps the system in defrost until cyclic timer 80 acts to terminate it. Naturally, at the end of defrost, when timer motor 150 moves moving contact away from its position on stationary contact 85 (for defrost contact) to its position on contact 75 (the refrigerating contact) relay 165 drops out, that is, resumes its opened condition of contacts 210 and 230. When this has occurred, defrost cannot again occur until there has been enough compressor operating time for timer 180 to cause its movable contact 200 to move from its refrigerating position on contact 185 to its permissive defrost position on contact 190. In this way, a series of systems, each with independent timers, can have their individual cyclic timers 150 all set to begin defrost at the same time and yet only those systems which have accumulated sufficient compressor operating time since the last defrost to require a defrost will be allowed to actually initiate defrost. The other units, those whose compressors have not accumulated enough operating time to allow a defrost to initiate, will, during each defrost cycle, simply have their fans turn off and their compressor stop to allow the defrost of the systems requiring it without interference by excessive air motion within the freezer.

Figure 5:
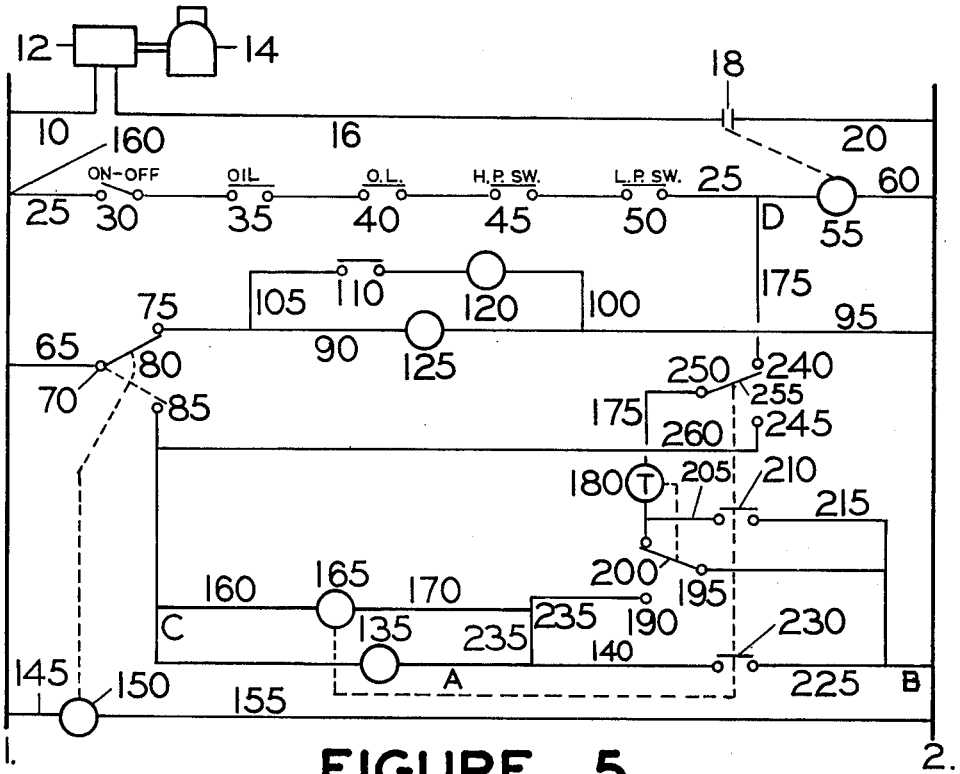
FIG. 5 is a schematic wiring diagram of a control system for both refrigeration and defrost which demonstrates the principle of this invention and which will serve both the hot gas defrost system of FIG. 1 and the electric defrost system of FIG. 2.

FIG. 5 is a modification of the schematic diagram of FIG. 4 which makes it suitable for use with electric defrost systems as in FIG. 2 where the compressor stops during defrost. FIG. 5 allows the timer 180 to run during the course of the defrost even though the compressor is stopped. The timer 180 must run for the purpose of allowing movable contact 200 to move from its position on defrost permissive contact 190 to contact 185. The modification is achieved by inserting a single pole double pole switch in lead 175 of timer motor 180. This switch, which will be referred to by the numeral of its moving contact, 225, is actuated by the same magnetic coil 165 which actuates contacts 210 and 230. When relay coil 165 is deenergized, moving contact 255 is on stationary contact 240 which establishes a schematic wiring diagram which is effectively identical to that of FIG. 4 since Position D on magnetic contactor lead 25 is connected directly by these switch elements 240, 255, 250 to timer motor 180. However, when the timer 180 has caused its moving contact 190 and timer 150 has caused the defrost to initiate by moving its moving contact 80 from its refrigerating position on contact 75 to it defrost position on contact 85, then the energization of magnetic coil 165 not only closes contacts 210 and 230 but also causes the moving contact 225 to move from stationary contact 240 to stationary contact 245. In this position, even though the compressor may be off, as in the case of an electric defrost (FIG. 2) power is supplied to timer motor 180 from power supply line 1 through defrost timer lead 65, moving contact 80, and stationary defrost contact 85, through lead 130, and 260 leading to stationary contact 245, moving contact 255, terminal 250, and finally, lead 175 of permissive timer 180. In this way, during the course of the defrost, permissive timer 180 can operate for the purpose of causing its moving contact 200 to move off its defrost permissive position on contact 190 and on to its time accumulative position on contact 185. In this way also when defrost cyclic timer 150 terminates the defrost by moving the moving contact 80 from the defrost position on contact 85 to the refrigerating position on contact 75, permissive timer 180 has its moving contact on stationary contact 185 ready to accumulate time of operation of the compressor. This is achieved on the termination of defrost by the deenergization of magnetic coil 165 which allows moving contact 255 to revert from its position on stationary contact 245 where in effect it was in parallel with magnetic coil 165 to its former position on stationary contact 40 which essentially is a reproduction of the schematic circuit shown in FIG. 4. This allows timer T to operate whenever the compressor magnetic contact coil 55 is energized.

Figure 6:
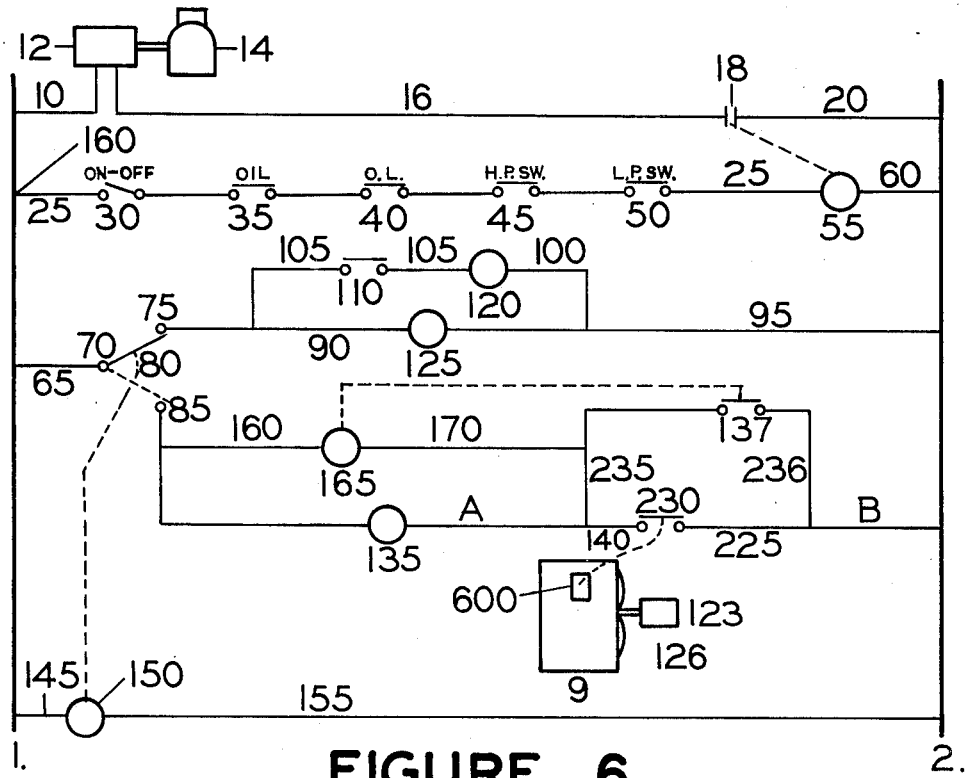
FIG. 6 is a schematic wiring diagram of a refrigeration and defrost control circuit which can function with either hot gas defrost or electric defrost systems but which utilizes a permissive element which does not depend directly on a compressor operating time.

Schematic diagram FIG. 6 is like that of FIGS. 3, 4 and 5, as far as the compressor power and control circuit. It is functionally like FIG. 5 in that it will work satisfactorily on either hot gas or electric defrost systems, that is, either on systems where the compressor operates during the course of the defrost, or where the compressor stops during the course of the defrost. However, it is unlike either FIGS. 4 or 5 in that it does not use a permissive timer which accumulates the running time of the refrigerating compressor. Instead, it uses a defrost sensing means 600 which acts to close switch 230 whenever sufficient frost has accumulated on the cooling coil to warrant allowing a defrost to occur. The element 600 shown in FIG. 6 represents any one of the following types:

1. Air pressure differential type. This type employs a sensor to the air pressure differential across the frosting coil and actuates a switch to initiate defrost when enough frost has accumulated to increase the static resistance to air movement and therefore the air pressure differential across the coil to a preset value.

2. Air velocity type. Accumulated frost on the coil reduces the air velocity through it by partly or fully blocking the air flow passages. An air velocity sensor initiates defrost when the air velocity falls below a preset value.

3. Temperature drop of the air traversing the cooling coil. This temperature drop increases as the air quantity across the coil is reduced by the interfering effect of the accumulated frost. Defrost is initiated when the temperature drop increases to a preset value.

4. Temperature difference between the evaporating refrigerant in the frosting element and the air temperature traversing the coil. This temperature difference increases as the capacity of the element is reduced through the reduction in air quantity caused by the accumulation of frost on the refrigerating element. Defrost is initiated when the temperature difference increases to a preset value.

5. Compressor operating time. Here a timer is connected to run only when the compressor is running. This timer accumulates or integrates the compressor operating time until a pre-determined total compressor operating time has occurred, at which time it allows defrost to initiate.

I claim:

1. An improved refrigerating system including conduit connected compressor, condenser and a frosting evaporator, said evaporator having a motor driven fan, defrost means capable of acting on the evaporator to defrost it, wherein the improvement comprises; cyclic means adapted to stop the fan and simultaneously attempt to initiate defrost at predetermined times blocking and unblocking means acting to allow the cyclic means to initiate defrost and prevent the cyclic means from initiating defrost, permissive means operative connected to the blocking and unblocking means and positioned to sense a condition related to the amount of frost on the evaporator, said permissive means causing the blocking and unblocking means to block initiation of defrost on a first value of the condition and causing the blocking and unblocking means to unblock initiation of defrost on a second value of the condition, said first value being related to the presence of a lesser amount of frost on the evaporator, and said second value being related to the presence of a greater amount of frost on the evaporator.

2. A system as in claim 1 wherein the permissive means is a timer connected to operate substantially simultaneously with the compressor.

3. A system as in claim 1 wherein the permissive means is a control selected from the group consisting of air pressure differential type, air velocity type, air temperature drop type, and (evaporating refrigerant-air) temperature difference type.

4. A system as in claim 1 where the blocking and unblocking means is a switch, positioned to allow and prevent energization of the defrost means.

5. An improved defrost control for a refrigeration system, said system including at least one frosting evaporator, said evaporator having a motor driven fan, and defrost means actuated by the control for periodically defrosting the evaporator, said control comprising cyclic means adapted to stop the fan and simultaneously attempt to initiate defrost at predetermined times, wherein the improvement comprises; blocking and unblocking means acting to allow the cyclic means to initiate defrost, and prevent the cyclic means from initiating defrost, permissive means operatively connected to the blocking and unblocking means and positioned to sense a condition related to the amount of frost on the evaporator, said permissive means causing the blocking and unblocking means to block initiation of defrost on a first value of the condition and causing the blocking and unblocking means to unblock initiation of defrost on a second value of the condition, said first value being related to the presence of a lesser amount of frost on the evaporator, and said second value being related to the presence of a greater amount of frost on the evaporator.

6. An improved control as in claim 5 wherein the permissive means is a timer connected to operate substantially simultaneously with the compressor.

7. An improved control as in claim 5 wherein the permissive means is a control selected from the group consisting of air pressure differential type, air velocity type, air temperature type, and (evaporating refrigerant-air) temperature difference type.

* * * * *

UNITED STATES PATENT AND TRADEMARK OFFICE

CERTIFICATE OF CORRECTION

PATENT NO. : 3,992,895

DATED : Nov. 23, 1976

INVENTOR(S) : Daniel E. Kramer

It is certified that error appears in the above-identified patent and that said Letters Patent are hereby corrected as shown below:

Column 2, line 30, delete "occurs" and insert in its place -- been --.

Column 2, line 31, delete "occuts" and insert in its place -- occurs --.

Column 12, Claim 1, line 26, delete "operative" and insert in its place -- operatively --.

Signed and Sealed this

Twelfth Day of April 1977

[SEAL]

*Attest:*

RUTH C. MASON
*Attesting Officer*

C. MARSHALL DANN
*Commissioner of Patents and Trademarks*